United States Patent [19]

Mills

[11] Patent Number: 4,986,000

[45] Date of Patent: Jan. 22, 1991

[54] BAG SEALER AND CUTTER

[76] Inventor: Richard L. Mills, 6528 Almaden Rd., San Jose, Calif. 95120

[21] Appl. No.: 299,607

[22] Filed: Jan. 23, 1989

[51] Int. Cl.[5] ..... B26B 3/00

[52] U.S. Cl. ..... 30/278; 30/2; 30/296.1; 493/963; 493/57

[58] Field of Search ..... 30/278, 2, 1, DIG. 3, 30/296.1; 493/57, 268, 963

[56] References Cited

U.S. PATENT DOCUMENTS 2,204,267 6/1910 Wyres ..... 30/2
4,514,902 5/1985 Stewart ..... 30/2
4,570,339 2/1986 Taylor ..... 30/2
4,599,758 7/1986 Stiles ..... 30/2 X

*Primary Examiner*—Douglas D. Watts
*Assistant Examiner*—Willmon Fridie, Jr.
*Attorney, Agent, or Firm*—Paul B. Fihe

[57] ABSTRACT

Disclosed herein is a bag sealer and/or cutter including a hollow resilient core member over which the end of a paper or plastic bag can be folded, whereupon a resilient cover member can be applied thereover to effect sealing closure of the open end of a bag. The cover member also mounts an interior cutting blade to facilitate the initial opening of the bag.

4 Claims, 1 Drawing Sheet

BAG SEALER AND CUTTER

FIELD OF THE INVENTION

The present invention relates generally to resealable closures for packages, and more particularly, to a sealer and cutter for the ends of flexible bags.

BACKGROUND OF THE INVENTION

Plastic or paper bags having contents such as potato chips, nuts, and many other products are sealed to assure freshness However, after initial opening and partial dispensing of the contents, the remaining contents are exposed to air and soon lose their freshness and flavor. Various clips or the like have been proposed for bag resealing but have been ineffective and difficult to apply properly. The resealing problem is rendered more difficult because initial opening of the bag is frequently irregular.

SUMMARY OF THE PRESENT INVENTION

Accordingly, it is the general objective of the present invention to provide a bag sealer and cutter which is a simple inexpensive structure, which can be used to provide a straight cut to open one end of the bag and can subsequently be readily applied to the opened end of a bag in a fashion which assures effective but removable sealing closure of the bag.

To achieve this objective, the bag sealer is composed of essentially two elements which can be simply joined over the open end of a bag to effect the sealing closure thereof.

One element is an elongated hollow core member over which the bag can be folded. Thereupon a hollow tubular slotted cover member, the second element, can be applied thereover to effect sealing closure of the bag. Mere withdrawal of the cover member from over the core member and bag provides access to the bag contents.

Adjacent one end of the cover member, a sharp blade projects inwardly so the bag can be inserted and moved along the blade to effect initial opening of the bag. Thus, the cover member provides a dual function.

BRIEF DESCRIPTION OF THE DRAWING

The stated objective of the invention and the manner in which it is achieved, as summarized above, will be more fully understood by reference to the following detailed description of the exemplary embodiment of the invention illustrated in the accompanying drawing wherein.

DETAILED DESCRIPTION OF THE ILLUSTRATED EMBODIMENT OF THE INVENTION

Figure 1:
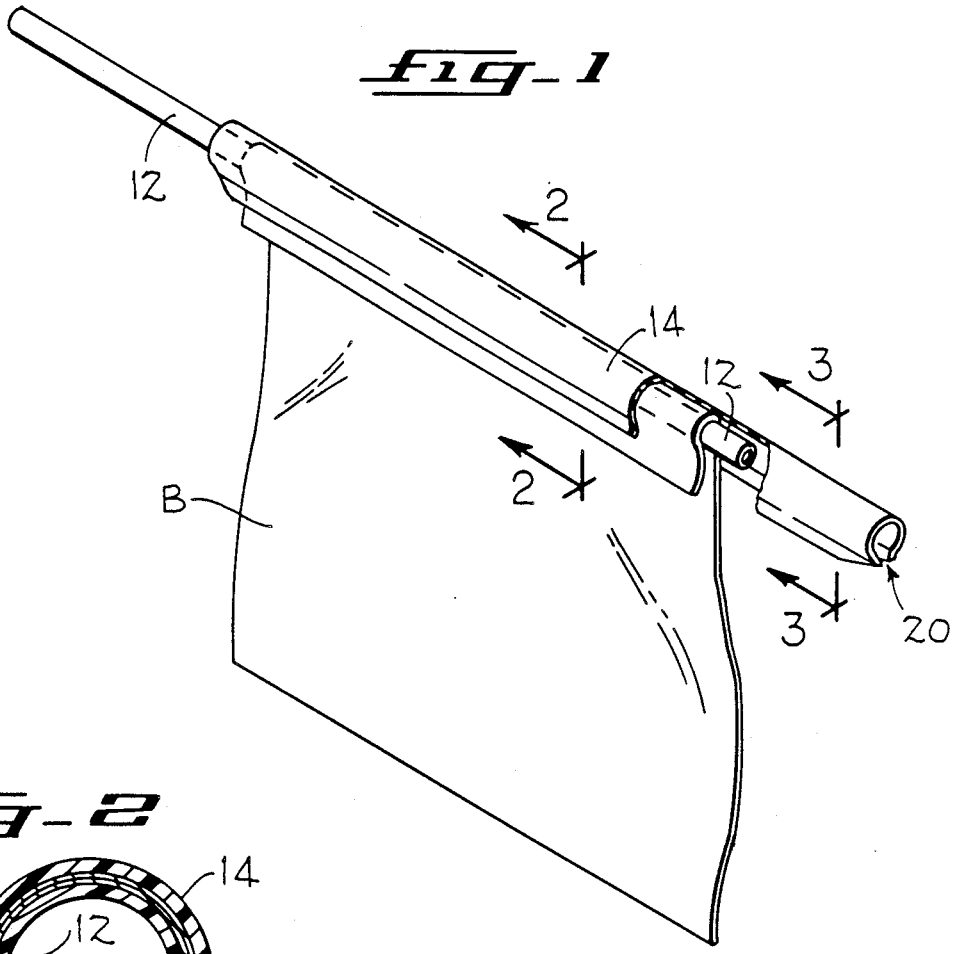
FIG. 1 is a perspective view of a bag sealer in sealing contact with one end of a plastic bag.

As generally shown in FIG. 1 the illustrated bag sealer and cutter is composed of two elements, a core member 12 over which the end of a bag B can be folded, and a cover member 14 which can be applied over the core member 12 and the bag B thereon to effect a sealed closure of the bag.

More particularly, the core member 12 is an elongated generally cylindrical tube composed of resilient material and having slightly overlapping edges 16, 18. Thus, if inward pressure is applied to the core member 12, it can collapse to a lessened diameter.

Figure 2:
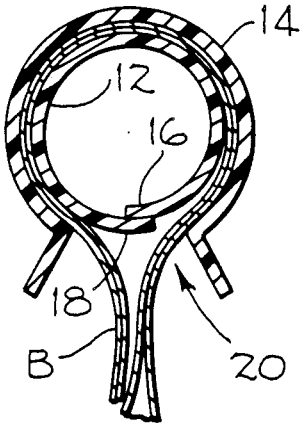
FIG. 2 is an enlarged cross-sectional view taken along line 2—2 of FIG. 1, FIG. 3, is another enlarged cross-sectional view taken along line 3—3 of FIG. 1.
Figure 3:
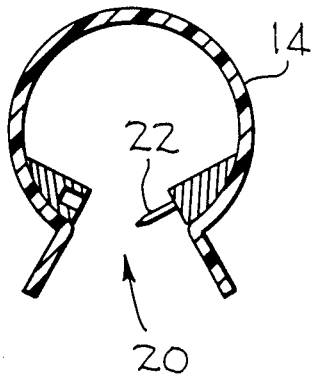

The opened end of a bag B can be easily folded thereover as best shown in FIG. 2.

In order to effect the sealed closure of the bag B the second element, the cover member 14 can be snapped thereover. For this function, the cover member 14 takes the form of a generally semi-cylindrical tube composed of resilient material. More particularly, the cover member 14 is slightly more than 180° in its circumferential extent thus leaving a longitudinal slot 20 enabling snapped placement over the bag B and core member 12. Preferably, the cover member is flared outwardly adjacent the edges of the slot 20 to facilitate placement over the bag B and core member 12. The resilience of the core member 12 and the cover member 14 enables the easy accommodation of bags B of slightly variant thicknesses.

Figure 4:
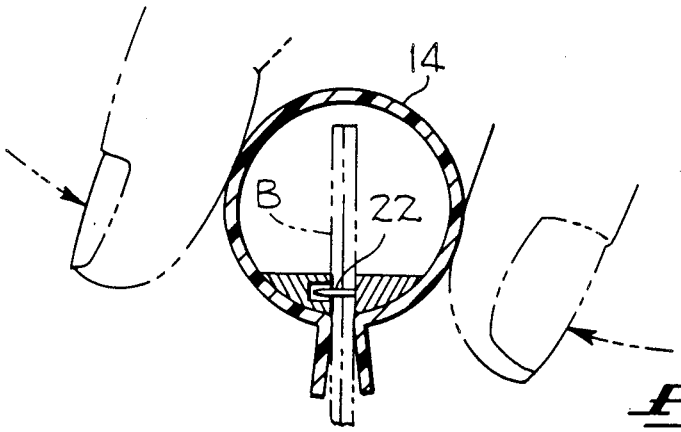
FIG. 4 is a view similar to FIG. 3 illustrating the cutting action on a bag.

The cover member 14 also accommodates a cutting blade 22 which projects inwardly therewithin to enable cutting of an unopened bag B. As best shown in FIG. 4, the end of a bag B can be inserted into the interior of the cover member 14, and the cover member can be compressed to bring the cutting blade into severing contact with the bag. Relative movement enables a rectiliniar cutting action to open the bag B for access to its contents. Thus the formation and resilience of the cover member 14 performs two functions, sealing and cutting.

Various alterations and/or modifications of the described structure can obviously be made without departing from the spirit of the invention, and the description of the illustrated embodiment is not to be considered in a limiting sense, and the actual scope of the invention is to be indicated only by the appended claims.

What is claimed is:

1. A bag sealer which comprises an elongated core member over which the end of a bag can be placed, and an elongated cover member slightly larger than said core member and composed of resilient material with a longitudinal slot extending the entire length thereof enabling snapped reception over said core member and a bag thereon whereby the bag is pressed between said core member and aid cover member.

2. A bag sealer according to claim 1 wherein said core member is of cylindrical shape with overlapping edges and composed of resilient material wherefore inward force thereon can decrease its diameter.

3. A bag sealer according to claim 1 wherein said cover member is of generally cylindrical shape with outwardly flared edges adjacent its slot.

4. A bag sealer according to claim 3 which comprises a cutting blade projecting inwardly from said cover member.

* * * * *